United States Patent [19]

Alonso

[11] 4,089,468

[45] May 16, 1978

[54] TANKS HAVING MEMBRANES

[75] Inventor: D. Manuel Dominguez Alonso, Madrid, Spain

[73] Assignee: Astilleros y Talleres Del Noroeste S.A., Madrid, Spain

[21] Appl. No.: 779,339

[22] Filed: Mar. 21, 1977

[30] Foreign Application Priority Data

Sep. 27, 1976 Spain ..... 451.890

[51] Int. Cl.[2] ..... B65D 25/18; B63B 3/68

[52] U.S. Cl. ..... 220/441; 220/444; 220/445; 220/901

[58] Field of Search ..... 220/9 A, 9 LG, 10, 63 R, 220/15, 83

[56] References Cited

U.S. PATENT DOCUMENTS

| | | | |
|---|---|---|---|
| 2,971,667 | 2/1961 | Benson et al. | 220/10 |
| 3,191,792 | 6/1965 | Hunt | 220/10 X |
| 3,319,431 | 5/1967 | Clarke et al. | 220/9 LG X |
| 3,409,061 | 11/1968 | Struble, Jr. | 220/15 X |
| 3,528,582 | 9/1970 | Rigollot | 220/83 X |
| 3,941,272 | 3/1976 | McLaughlin | 220/9 LG |

FOREIGN PATENT DOCUMENTS

| | | | |
|---|---|---|---|
| 1,579,559 | 8/1969 | France | 220/10 |
| 31,436 | 1971 | Japan | 220/9 LG |
| 525,687 | 9/1940 | United Kingdom | 220/83 |
| 1,442,399 | 7/1976 | United Kingdom | 220/9 LG |

*Primary Examiner*—Stephen Marcus

*Attorney, Agent, or Firm*—Melville, Strasser, Foster & Hoffman

[57] ABSTRACT

Membrane tank having utility for the transportation and storage of liquefied gases, such as liquefied natural gas, the tank wall being comprised of two sets of warped surfaces with double curvatures, all sections of which are curved, with the surfaces of both sets being alike but having curvatures in opposite directions, some being concave and others convex in an alternating arrangement and being tangent at their common borders, each of said surfaces being anchored to a second outer wall by means of columns or partitions which project perpendicularly to a plane defined by the vertices of the warped surfaces.

13 Claims, 6 Drawing Figures

TANKS HAVING MEMBRANES

BACKGROUND OF THE INVENTION (1) Field of the Invention

The present invention concerns improvements in membrane tanks specially designed for the storage and transport of liquids at low temperatures, such as liquified gases.

The invention is of special applicability in the transport of liquified gases aboard ships.

(2) Description of the Prior Art

The transport of liquified gases aboard ships, for instance natural gas, is acquiring more importance every day due to the increase in the consumption of these gases, as well as the fact that the places or countries which consume the most of it, do not, in general, coincide with the producing zones or countries.

The transport and storage of natural gas or other gases in liquid state poses big problems, due to the low temperatures at which it is transported. These temperatures are usually around −162° C.

Such low temperatures cause contractions in the walls of the tanks which lead to strong tensions.

In case of transport aboard ships, besides the thermal problems already pointed out, others, of mechanical and safety nature must be added.

The mechanical problems derive from vibrations, flexions, change of pressure, and, in general, from the movements of the ship, which expose the walls of the tanks to considerable static and dynamic effects.

The safety problems are due to the demands of the international organizations involved in classification, which demand a second waterproof barrier able to retain the possible leaks of the tank, so that the leaked liquid cannot enter in contact with the structure of the ship, which being basically made of ordinary steel, would not be able to endure the low temperatures of the liquid.

Presently, for the storage and transport of liquified gases, two types of tanks are essentially used — self-carrying tanks, and integral or membrane tanks which are made of special alloys of steels or aluminum.

In the self-carrying tanks, the walls are made of high thickness, able to resist the thermal tensions, as well as the static and dynamic effects due to the thermal and mechanical stresses mentioned before.

With the integral or membrane tanks, however, the walls are of reduced thickness having the sole function of a watertight or curb barrier. In this type of tank, the wall lacks it own rigidity passing onto the outer carrying structure all static and dynamic pressures. Thermal tensions are avoided, in these tanks, by building the walls with special alloys, such as INVAR, of low dilatation factor, or, with steels with less nickel content, thus making on the wall undulations or corrugations conveniently spread out, which would act as bellows able to absorb the contractions and dilatations originated by the changes of temperatures.

In any event, the tanks would be covered with an insulating material. When the tanks are made of membrane, their walls are supported on the insulating coating, this being of enough rigidity to transmit the static and dynamic pressures onto the carrying structure.

Regardless of whether the tanks are of the self-carrying or membrane type, their construction, secondary and insulating barrier, as well as their installation, must be made separately, all of which should be considered in the final cost of the whole structure.

SUMMARY

The present invention concerns membrane tanks, and has as its main purpose the simplification of the construction of the tank and the disposition of its insulation, as well as the construction of the secondary barrier.

The special configuration of the wall and secondary barrier, according to the present invention, allows the building of such a wall and secondary barrier starting with the materials traditionally used in this type of tanks, or, also with basically which optionally may be reinforced plastic materials , allowing in both instances to simplify and lower the cost considerably of the construction and installation of the combination tank-insulation-secondary barrier.

According to the present invention, the tank wall is composed of two sets of warped surfaces, with double curvature, all sections of which are curved in any plan view, the surfaces of both sets being alike but having curvatures in opposite directions, some being concave and others being convex in an alternating arrangement, said surfaces being tangent at their common borders, each of said surfaces being anchored to a second outer wall by means of partitions which extend perpendicularly to a plane defined by the vertices of said surfaces.

The outer wall can be the same carrying structure, on which the tank is mounted, or a wall independent of the carrying structure which surrounds the tank and which is of the same nature as the tank wall, thus arranging perpendicularly the joining partitions or columns between this second wall and the wall of the tank.

The mentioned second wall serves, in this case, is a secondary barrier, allowing in between, a space in which an elastic material can be used to serve as an insulating coating for the tank.

With this arrangement the tank wall and secondary barrier can be constructed at the same time, as well as the insulating coating. This construction can be made with portions or modules of proper dimension to facilitate its manipulation, thus joining together such modules in order to form the whole of the tank wall, secondary barrier and insulating coating.

The second wall surrounding the tank should perferably be parallel to the plane defined by the vertices of the warped surfaces forming the tank wall, which will allow the joining partitions or columns to extend perpendicularly between the tank wall and the second wall.

The second wall can be either flat or can also be formed by warped surfaces symmetrical with the warped surfaces which form the tank wall, in relation to the intermediate plane parallel to the surface defined by the vertices of the warped surfaces which form the wall of the tank. With this arrangement, the partitions or joining columns will extend perpendicularly between the contour of the symmetrical warped surfaces of both walls.

When the second wall is also composed of warped surfaces, this second wall can be surrounded by a third wall parallel to the plane defined by the vertices of the warped surfaces of the tank wall, connecting the warped surfaces which compose the second wall to the third wall by partitions or columns which extend from the contour of said warped surfaces and which are perpendicular to the plane defined by the vertices of the warped surfaces and to the third wall.

Thus a unit defined by three walls is obtained: one inner wall composed of warped surfaces which defines the tank wall; one intermediate, also composed of warped surfaces; and a flat outer wall which can rest directly on the carrying structure.

The third wall can also be of the same material as the first and second walls, as well as the joining partitions.

The structure of the tank-insulation-secondary barrier unit, in the case of the three walls, can be constructed as in the case of two walls, by modules which are joined together.

The connecting partitions are spaced along the contours of all the warped surfaces defining between two walls cells or compartments, which can be watertight, or feature intermediate openings for intercommunication between cells. In the case where the connection between two walls is made through columns, such columns will start from the common borders of the warped surfaces.

The warped surfaces present in plan view, a curvilinear polygonal contour, with sides of equal longitude, but whose contigous sides have equal curvature but of a different sign. The contour, in top plan view, of these warped surfaces will preferably be in the shape of a curvilinear quadrilateral with the adjacent sides of equal curvature, but of different sign.

The wall surrounding the tank and the second wall, as well as the third wall, if provided, and also the connecting partitions and columns can be made with, basically plastic material which may optionally be reinforced.

With a base of plastic material modular blocks can be made which can comprise the tank wall, the second wall and the third wall, in case of having it, as well as the connecting partitions or columns. These modules can be joined together by adhesive, for instance, until a closed and watertight space is obtained, which is already equipped with a secondary barrier and between whose wall an insulative material can be injected to act as an isolating coating for the tank.

If desired, the outer wall, be it the second or third wall, can be anchored to the carrying structure.

The structure obtained with a base of a plastic material can be reinforced later on with an "in situ", stratus of the outer surface.

If desired, depending on the characteristics of the tank, the surfaces which form the wall could be spherical of cylindrical.

In accordance with the invention, membrane tanks are constructed in which the tank wall absorbs the contractions and dilatations which occur due to changes of temperature diminishing or increasing the curvature of the warped surfaces. The static and dynamic pressures are transmitted to the outer wall through the connecting partitions or columns and, from there, to the carrying structure. The secondary barrier is defined by the second and third wall, in case it has the latter, and the insulating coating is obtained by the injection of an isolating material between the inner and outer walls of the tank.

BRIEF DESCRIPTION OF THE DRAWING

In order for the characteristics and advantages aforementioned to be more easily understood, a more detailed description follows which refers to the attached drawings, in which, in a schematic manner, exemplary embodiments are shown as follows.

DESCRIPTION OF THE PREFERRED EMBODIMENTS

Figure 1:
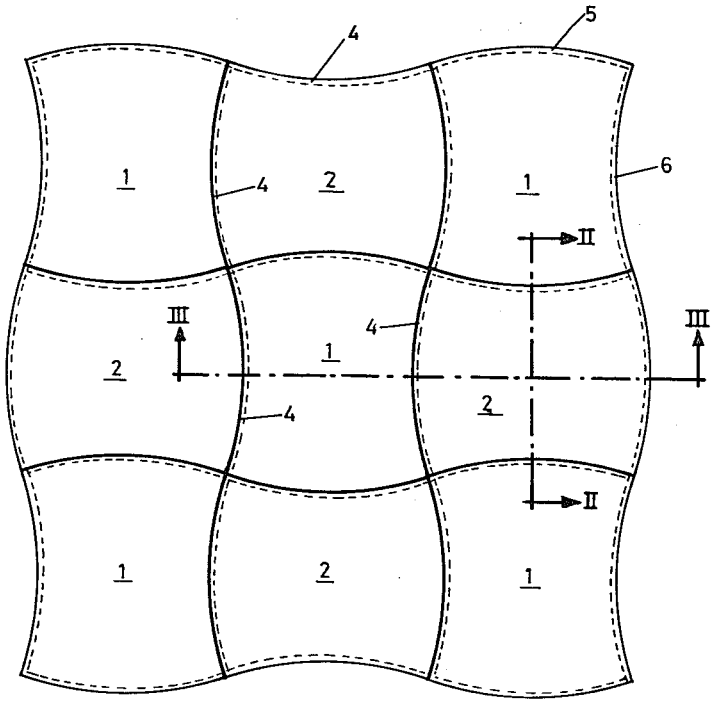
FIG. 1, a top plan view of a portion of a tank wall constructed according to the invention.
Figure 2:
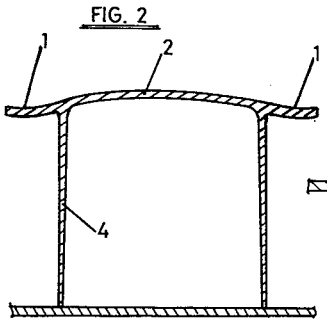
FIG. 2, a section along-the line II—II of FIG. 1.
Figure 3:
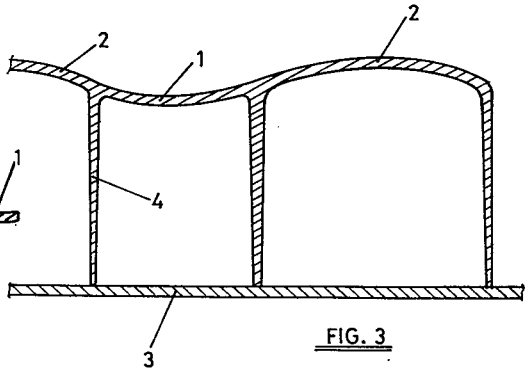
FIG. 3, a section, along-the line III—III of FIG. 1.

As can be seen in FIGS. 1, 2 and 3, the tank wall is composed of two units of warped surfaces, with double curvature, whose sections, according to any plan, are all curved, the surfaces of both units being equal but with the curvature in opposite direction, some concave, indicated by reference number 1 and others convex, indicated by reference number 2. As can be clearly seen in FIG. 1, these warped surfaces are disposed in alternated arrangement. Moreover, as shown in FIGS. 2 and 3, both surface units are tangent at their common borders.

The surfaces of both units are anchored to a second outer wall 3 through intermediate columns or partitions 4 which extend perpendicularly from the contour of surfaces 1 and 2, the partitions which limit surfaces 1 and 2 being represented in FIG. 1 by lies of double dots.

Outer wall 3 can be flat, as shown in FIGS. 2 and 3 and can constitute the carrying structure on which the deposit is mounted.

Between the deposit wall, defined by surfaces 1 and 2, and the outer wall 3, a space is defined which is spanned by the columns or partitions 4 in which space an insulating material can be used to serve as an insulative coating for the tank.

In the example illustrated in the drawings, the warped surfaces present in the plan view, a contour in the shape of a curvilinear quadrilateral whose adjacent sides 5 and 6 have equal curvature but of a different sign.

The partitions serving as continuous connecting elements on the warped surfaces with wall 3 define between the tank wall and wall 3 watertight cells, which, if desired, can intercommunicate between themselves through vertical openings in said walls.

If the anchorage of the tank wall to wall 3 is made by means of discontinuous columns, these will extend from the vertex of the warped surfaces, although columns can also be arranged at intermediate points on the borders or contours of the warped surfaces.

As can be easily understood, the contour of the warped surfaces can be different from the one shown in FIG. 1, being, in general, polygonal and curvilinear, with the adjacent sides of equal curvature but different sign.

Wall 3 can be of the same nature as the tank wall, as well as the partitions or intermediate columns 4, and said wall 3 being parallel to the plane defined by the vertices of the warped surfaces 1 and 2, which will cause the columns or intermediate partitions to be disposed perpendicularly between the borders of the warped surfaces 1 and 2 and wall 3.

Figure 4:
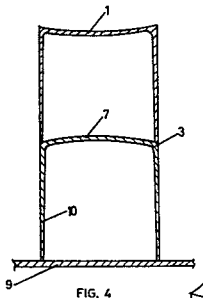
FIGS. 4 and 5 correspond to similar views as shown in FIGS. 2 and 3 in a different embodiment.
Figure 5:
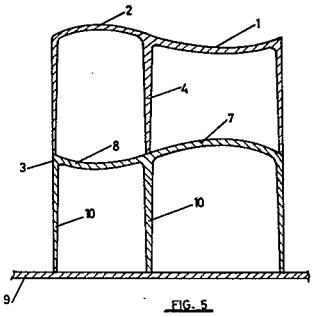

According to a different embodiment, shown in FIGS. 4 and 5, the second wall 3, instead of being flat can be composed of two units of warped surfaces 7 and 8 symmetrical to the warped surfaces 1 and 2 which form the tank wall, the intermediate surface of the second wall being parallel to the plane defined by the vertices of the warped surfaces 1 and 2, connecting as in the previous case the tank wall and the second wall 3 by means of the columns or intermediate partitions 4, which are perpendicular to the warped surfaces of both walls and are arranged according to the contours of such surfaces. In this case, wall 3 will be surrounded by a third flat wall 9, and between this and the third wall 3 connecting, intermediate columns or partitions 10, are arranged, perpendicular to the warped surfaces 7 and 8 and the flat wall 9.

The unit which defines the tank will be, in this case, composed of an inner wall, by means of the warped surfaces 1 and 2, an intermediate wall 3, by means of warped surfaces 7 and 8 which are symmetrical with 1 and 2, and a third outer flat wall 9. These three walls, as well as the connecting, intermediate columns or partitions 4 and 10 will be preferably of the same nature, composed, for instance, of plastic material which may be reinforced, if desired.

The whole unit defining the tank can be obtained by molding, directing the first step to the warped surfaces 1 and 2 and partitions 4. In a second step, the warped surfaces 7 and 8 could be obtained, and also partitions 10. And, in a third step, the flat wall 4, joining inbetween as shown in FIGS. 4 and 5 is formed by fusion or welding, in order to get a unit which defines spaces in between the three walls, spaces in which the proper insulating material can be placed. With this system, the tank wall and the secondary barrier can be obtained, as well as the insulating coating.

The flat wall 9, in the case of FIGS. 4 and 5, and wall 3, in the case of FIGS. 2 and 3, will rest directly on the carrying structure on which the tank or deposit is mounted.

Figure 6:
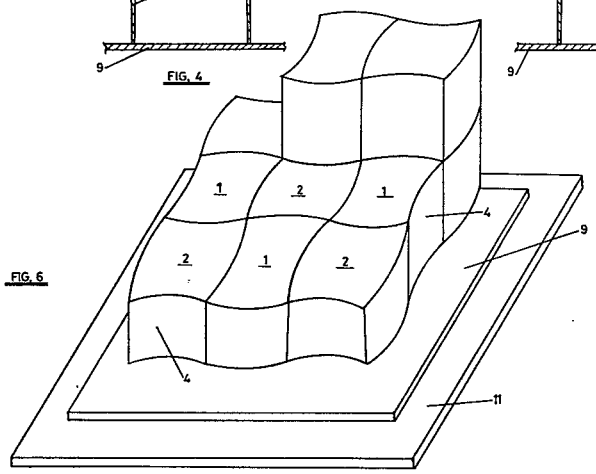
FIG. 6 is a perspective view of a portion of the tank wall.

The tank wall can be constructed starting with modules, as shown in FIG. 6, on one floor, thus including the enabling embodiment shown in FIGS. 2 and 3. It could also consist of two floors, as shown in FIGS. 4 and 5.

The modules will remain laterally defined by warped surfaces inflected in the adjacent walls, so that the coincidence in between united modules is simple and fast. If the intermediate walls and partitions are constructed with a plastic material, the joining can be made by fusion or adhesion.

In FIG. 6, reference numeral 11 shows the carrying structure, on which the third wall 9, or second wall 3 rests, depending whether the unit is of two or one tiers.

In these modules, the intermediate partitions 4 which serve as connecting elements close laterally the space of the modules, creating watertight modules, in which the insulating material could have been previously injected.

In general, with the procedure of this invention, membrane tanks are obtained in which the wall that limits or defines the tank is formed by two sets of warped surfaces which absorb by deformation the contractions and dilatations due to thermal effects. At the same time, a secondary barrier and insulation of the tank are obtained, simplifying greatly the structure of the same.

On the other hand, by being able to use plastic materials which may be reinforced, the construction is simplified further, allowing the obtention by molding of modules which are united between themselves by fusion or pitching, reducing the cost of the tank by using a more economical material, and at the same time reducing the weight of the tank and the time of fabrication of the same.

The tanks built according to the invention can be utilized for the transport of liquefied gases aboard ships, or on any other vehicle. They could also be used as storage tanks.

After fully describing the nature of the invention, as well as the manner in which it can be executed in practice, it must be noted that the embodiments aforementioned are suseptible to modifications so long as they do not alter its fundamental principle.

I claim:

1. A membrane tank having a wall comprised of two sets of warped surfaces, with double curvatures, all sections of which are curved in any plan view, the surfaces of both sets being alike but having curvatures in opposite directions, some being concave and others being convex in an alternating arrangement, said surfaces being tangent at their common borders, each of said surfaces being anchored to a second outer wall by means of partitions which extend perpendicularly to a plane defined by the vertices of said surfaces.

2. The tank claimed in claim 1, wherein the warped surfaces present in top plan view, a curvilinear polygonal contour, adjacent sides of which have equal curvatures but a different sign.

3. The tank claimed in claim 1, wherein the outer second wall surrounds the tank, and is of the same material as the wall of said tank, the connecting partitions being arranged perpendicularly between said second wall and the tank wall.

4. The tank claimed in claim 3, wherein said second wall which surrounds the tank is parallel to the plane defined by the vertices of the warped surfaces which form the tank wall.

5. The tank claimed in claim 3, wherein the wall surrounding the tank is symmetrical to the tank wall, with respect to the parallel intermediate surface, to the plane defined by the vertices of the warped surfaces which form the wall of the tank with the connecting partitions being perpendicularly positioned between the contour of the warped surfaces symmetrical to both walls.

6. The tank claimed in claim 5, wherein the wall surrounding the tank is disposed on a third wall parallel to the plane defined by the vertices of the warped surfaces of the tank wall, the warped surfaces of the second wall which surrounds the tank being connected to said third wall by means of partitions which extend from the contour of the said warped surfaces.

7. The tank claimed in claim 2, wherein the connecting partitions are positioned along the contours of all the warped surfaces, defining cells therebetween.

8. The tank claimed in claim 2, wherein the connecting partitions extend from the vertices of the warped surfaces.

9. The tank claimed in claim 7, wherein the cells are watertight.

10. The tank claimed in claim 7, wherein the connecting partitions are provided with intermediate openings for the intercommunication of the cells with one another.

11. The tank claimed in claim 5, wherein the warped surfaces present in top plan view, a contour in the shape of a curvilinear quadrilateral, adjacent sides of which have equal curvature but a different sign.

12. The tank claimed in claim 3, wherein the tank wall, the wall surrounding the tank and the connecting partitions are made of a plastic material.

13. The tank claimed in claim 12, wherein independent modules are shaped by molding, laterally limited by intermediate connecting partitions which surround the peripheral warped surfaces, limited at the top by the warped surfaces which define the tank wall and below by a flat wall which is disposed on a carrying structure.

* * * * *